United States Patent [19]

Breslow et al.

[11] 4,027,877

[45] June 7, 1977

[54] GAME DEVICE

[75] Inventors: Jeffrey D. Breslow, Highland Park; Mitchell J. Frumkin, Chicago, both of Ill.

[73] Assignee: Marvin Glass & Associates, Chicago, Ill.

[22] Filed: Aug. 13, 1975

[21] Appl. No.: 604,262

[52] U.S. Cl. ..... 273/1 R

[51] Int. Cl.[2] ..... A63B 67/00

[58] Field of Search ..... 46/91; 273/1 R, 144 R, 273/144 A, 144 B, 143 A, 143 R, 143 B, 145 A

[56] References Cited

UNITED STATES PATENTS

| | | | |
|---|---|---|---|
| 265,100 | 9/1882 | Kehoe | 273/144 A |
| 840,934 | 1/1907 | Grant | 273/144 A |
| 1,977,115 | 10/1934 | Conwill | 273/1 R |
| 2,148,097 | 2/1939 | Bowman | 273/145 A |
| 3,129,528 | 4/1964 | Gausewitz | 46/91 |
| 3,232,621 | 2/1966 | Michelson | 273/144 A |
| 3,645,533 | 2/1972 | Lester | 273/145 A |
| 3,771,790 | 11/1973 | Kong | 273/1 R |

FOREIGN PATENTS OR APPLICATIONS

| | | | |
|---|---|---|---|
| 360,356 | 8/1921 | Germany | 273/145 A |

*Primary Examiner*—William H. Grieb
*Attorney, Agent, or Firm*—Mason, Kolehmainen, Rathburn & Wyss

[57] ABSTRACT

A competitive game played with a bottle, the neck of which has restrictions or baffles located therein. Playing pieces are placed into the bottle through a slot in the side thereof, and the players of the game, in turn, attempt to shake a given number of playing pieces out of the bottle past the restrictions in the neck of the bottle, the restrictions interfering with the free movement of the playing pieces.

1 Claim, 3 Drawing Figures

GAME DEVICE

SUMMARY OF THE INVENTION

This invention relates to a competitive game device and particularly to a competitive game which includes a bottle-like device with a narrow neck and with playing pieces positionable in the bottle through a slot in the side thereof. Obstacles in the form of spaced radial rod-like restrictions or baffles are disposed within the neck of the bottle and are arranged in a somewhat spiral manner forming a restricted pathway requiring that the playing pieces be removed from the bottle by inverted shaking of the bottle. Various schemes of play are afforded by the game of the present invention, as exemplified hereinafter, the objectives usually being for the players to attempt to accumulate the most playing pieces.

DESCRIPTION OF THE PREFERRED EMBODIMENT

The present invention relates to a competitive game wherein playing pieces are deposited within a container in the form of a bottle. The neck of the bottle has obstacles in the form of restrictions or baffles on the inside thereof interfering with removal of the playing pieces from the bottle by shaking the bottle in an inverted manner.

Figure 1:
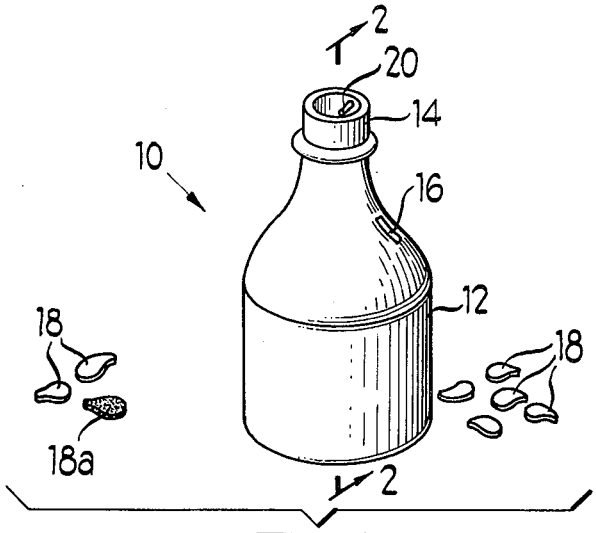
FIG. 1 is a perspective view of the game of the present invention.

More particularly, referring to FIG. 1, the game of the present invention, generally designated 10, includes a cylindrical bottle 12 with an upper reduced neck portion 14. A slot 16 is disposed in the side of the bottle 12 for insertion therethrough of a plurality of playing pieces into the bottle to start the game.

Figure 2:
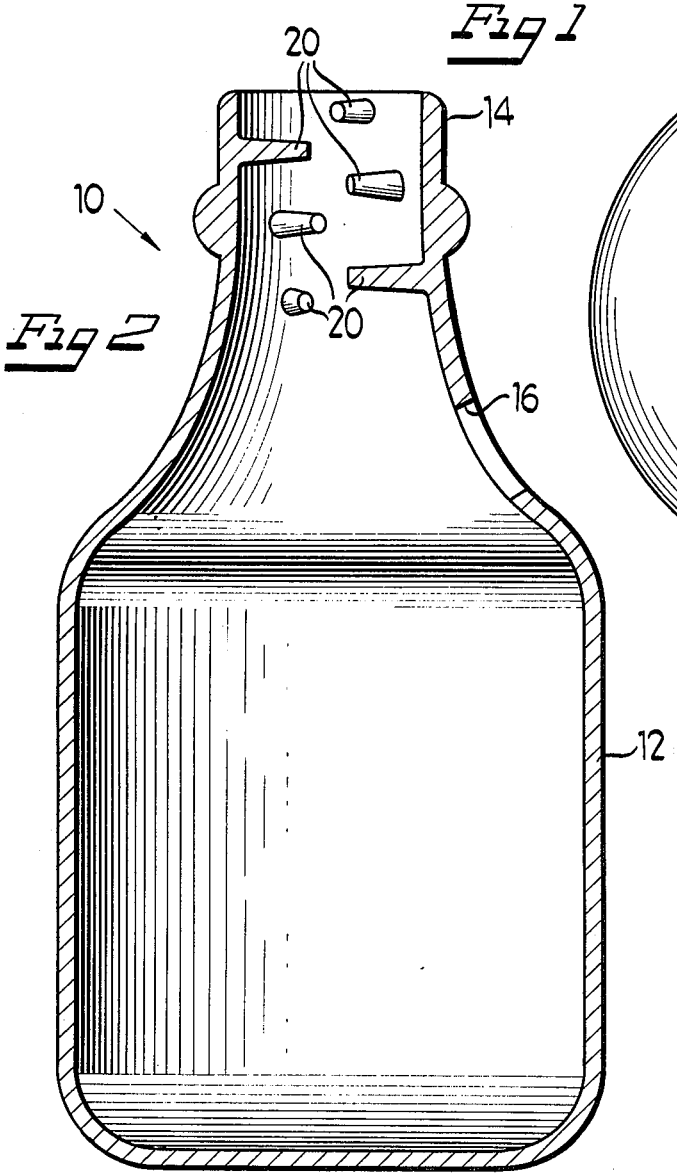
FIG. 2 is a vertical central section, on an enlarged scale, of the bottle portion of the invention taken generally along line 2—2 of FIG. 1.
Figure 3:
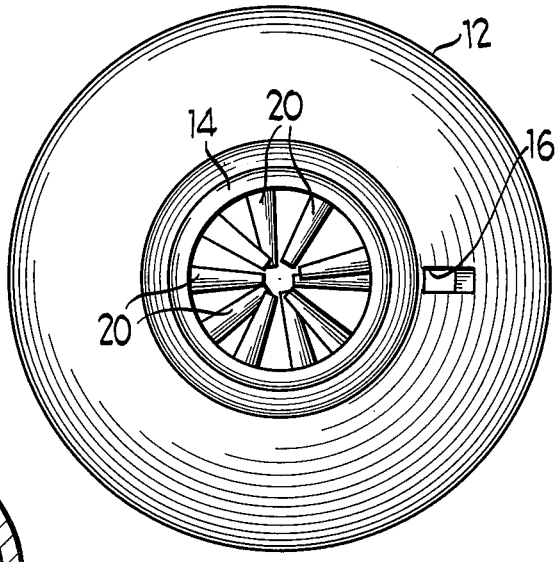
FIG. 3 is a top plan view of the bottle of FIG. 2.

A plurality of tapered elongated obstructions or baffles 20 are disposed in the upper neck portion 14 in position to inhibit the removal of the playing pieces 18 from within the bottle by upside-down shaking of said bottle. The obstructions 20 are in the form of short radially disposed tapered rods or studs spaced angularly and longitudinally within the neck 14, as shown in FIGS. 2 and 3. The rods are shown in general spiral relation forming a pathway therebetween for the playing pieces. The playing pieces 18 can be removed from the bottle past the obstructions 20 in the neck 14 by inverting the bottle and shaking the same or otherwise moving the bottle to disturb the playing pieces in an attempt to move them past the rods 20.

As seen in the drawings, in the exemplary embodiment of the invention, the bottle or container 12 is in the shape of a rounded ketchup bottle and the playing pieces 18 are in the form of "drops" of liquid material to simulate ketchup drops. As is known, it often times is somewhat difficult to shake commercially available ketchup out of their bottles and the shape of the bottle

12 and playing pieces 18 herein simulate such shaking motions.

Various schemes of play are afforded by the game of the present invention. For instance, as seen in FIG. 1, one of the playing pieces designated **18*a* may be of a different color than the other playing pieces. To start the game, all of the playing pieces are placed into the bottle through the slot 16. Each player then, in turn, grabs the bottle and inverts the same to shake any number of playing pieces from the bottle which that player desires. When the player stops for his turn, he may keep all of the playing pieces shaken from the bottle. However, whenever a player shakes the different playing pieces 18*a*** from the bottle during his turn, all of his playing pieces during that turn would have to be returned to the bottle.

Another scheme of play could be based on the known card game of "Twenty-one". In other words, a specific number of playing pieces would represent the maximum number that a player attempts to shake from the bottle during his turn. The player can stop at any time during his turn, but he cannot exceed the specific given number or all of his playing pieces must be returned to the bottle. During a round of play with this scheme, the player coming closet to the given number without going over either would win the round or would be the only player permitted to keep his playing pieces, and another round then is started.

Yet a further scheme simply would be that each player is given only a given number of shakes, such as three, during his turn and the player who has the most playing pieces at the end of that round would be the only player permitted to keep his playing pieces.

Various other schemes of play could be readily devised by utilizing the novel game combination of the present invention.

The foregoing detailed description has been given for clearness of understanding only and no unnecessary limitations should be understood therefrom as some modifications will be obvious to those skilled in the art.

We claim:

1. A game apparatus, comprising:

a container in the form of a bottle having an interior cavity and an opening thereto at the top of a reduced neck portion of the bottle;

a plurality of playing pieces smaller than said opening positionable into the interior cavity of said container;

restriction means at said opening permitting the playing pieces to pass thereby out of the container through said opening but inhibiting free movement of the playing pieces so as to require manual manipulation of the container by a player of the game in order to shake a given number of playing pieces out of the container, said restriction means including a plurality of rod-like baffles spaced angularly and longitudinally within said neck portion in a general radial disposition and extending only partially across the neck portion; and an aperture in the side of said bottle for replacing said playing pieces thereinto.

* * * * *